US008502755B2

(12) United States Patent
Liu et al.

(10) Patent No.: US 8,502,755 B2
(45) Date of Patent: Aug. 6, 2013

(54) CONTROL METHOD, DISPLAY PANEL AND ELECTRONIC SYSTEM UTILIZING THE SAME

(75) Inventors: Ping-Lin Liu, Tainan (TW); Du-Zen Peng, Jhubei (TW)

(73) Assignee: Chimei Innolux Corporation, Chu-Nan (TW)

( * ) Notice: Subject to any disclaimer, the term of this patent is extended or adjusted under 35 U.S.C. 154(b) by 1198 days.

(21) Appl. No.: 12/214,604

(22) Filed: Jun. 20, 2008

(65) Prior Publication Data

US 2009/0009540 A1 Jan. 8, 2009

(30) Foreign Application Priority Data

Jul. 4, 2007 (TW) ..... 96124279 A

(51) Int. Cl.
*G09G 3/32* (2006.01)

(52) U.S. Cl.
USPC ..... 345/82; 345/690

(58) Field of Classification Search
USPC ..... 345/76–83, 690
See application file for complete search history.

(56) References Cited

U.S. PATENT DOCUMENTS

| | | | | |
|---|---|---|---|---|
| 8,188,991 | B2 * | 5/2012 | Ohhashi et al. | 345/204 |
| 2005/0057580 | A1 * | 3/2005 | Yamano et al. | 345/690 |
| 2005/0285825 | A1 * | 12/2005 | Eom et al. | 345/76 |
| 2006/0028409 | A1 * | 2/2006 | Numao | 345/76 |
| 2006/0103324 | A1 * | 5/2006 | Kim et al. | 315/169.3 |
| 2006/0221101 | A1 * | 10/2006 | Azami | 345/690 |
| 2006/0221662 | A1 * | 10/2006 | Park et al. | 365/145 |
| 2007/0035487 | A1 * | 2/2007 | Ryu et al. | 345/76 |
| 2007/0188420 | A1 * | 8/2007 | Ichikura | 345/76 |

* cited by examiner

*Primary Examiner* — Ricardo L Osorio
(74) *Attorney, Agent, or Firm* — Liu & Liu

(57) ABSTRACT

A control method controlling a display panel comprising a pixel unit. The pixel unit is coupled to a data line and comprises a capacitor, a transistor, and a luminiferous device. The capacitor comprises a first terminal coupled to the data line and a second terminal coupled to the transistor. The voltage of the first terminal is increased and the voltage of the second terminal is reduced during a first period. The voltage of the first and the second terminals are controlled during a second period subsequent to the first period. The luminiferous device is lit according to the voltage of the capacitor during a third period subsequent to the second period. The voltage of the data line is maintained during the third period.

16 Claims, 5 Drawing Sheets

CONTROL METHOD, DISPLAY PANEL AND ELECTRONIC SYSTEM UTILIZING THE SAME

BACKGROUND OF THE INVENTION

1. Field of the Invention

The invention relates to a control method, and more particularly to a control method for controlling a display panel.

2. Description of the Related Art

Because cathode ray tubes (CRTs) are inexpensive and provide high definition, they are utilized extensively in televisions and computers. With technological development, new flat-panel displays are continually being developed. When a larger display panel is required, the weight of the flat-panel display does not substantially change when compared to CRT displays. Generally, flat-panel displays comprises liquid crystal displays (LCD), plasma display panels (PDP), field emission displays (FED), and electroluminescent (EL) displays.

Electroluminescence (EL) display devices include organic light emitting diode (OLED) displays and polymeric light emitting diode (PLED) displays. In accordance with associated driving methods, an OLED can be an active matrix type or a positive matrix type. An active matrix OLED (AM-OLED) display typically is thin and exhibits lightweight characteristics, spontaneous luminescence with high luminance efficiency and low driving voltage. Additionally, an AM-OLED display provides the perceived advantages of increased viewing angle, high contrast, high-response speed, full color and flexibility.

An AM-OLED display is driven by electric current. Specifically, each of the pixel units of an AM-OLED display includes a driving transistor and an OLED. The driving transistor provides a driving current such that the OLED is lit. The brightness of the OLED is determined by the driving current. Due to manufacturing procedures, different driving transistors comprise different threshold voltages. Thus, conventional OLEDs generate abnormal brightness.

BRIEF SUMMARY OF THE INVENTION

A control method and display panels are provided. The control method controls a display panel comprising a pixel unit. The pixel unit is coupled to a data line and comprises a capacitor, a transistor, and a luminiferous device. The capacitor comprises a first terminal coupled to the data line and a second terminal coupled to the transistor. An exemplary embodiment of a control method is described in the following. The voltage of the first terminal is increased and the voltage of the second terminal is reduced during a first period. The voltage of the first and the second terminals are controlled during a second period subsequent to the first period. The luminiferous device is lit according to the voltage of the capacitor during a third period subsequent to the second period. The voltage of the data line is maintained during the third period.

An exemplary embodiment of a display panel comprises a pixel unit and a cathode switch. The pixel unit comprises a capacitor, a first transistor, and a luminiferous device. The capacitor comprises a first terminal coupled to a data line and a second terminal. The voltage of the first terminal is increased and the voltage of the second terminal is reduced during a first period. The voltage of the first and the second terminals are controlled during a second period subsequent to the first period. The first transistor is coupled to the second terminal. The luminiferous device is lit according to the voltage of the capacitor during a third period subsequent to the second period. The voltage of the data line is maintained during the third period. The cathode switch is coupled to the luminiferous device.

Electronic systems are also provided. An exemplary embodiment of an electronic system comprises a display panel and a power converter. The power converter provides a power signal to the display panel. The display panel comprises a pixel unit and a cathode switch. The pixel unit comprises a capacitor, a first transistor, and a luminiferous device. The capacitor comprises a first terminal coupled to a data line and a second terminal. The voltage of the first terminal is increased and the voltage of the second terminal is reduced during a first period. The voltage of the first and the second terminals are controlled during a second period subsequent to the first period. The first transistor is coupled to the second terminal. The luminiferous device is lit according to the voltage of the capacitor during a third period subsequent to the second period. The voltage of the data line is maintained during the third period. The cathode switch is coupled to the luminiferous device.

A detailed description is given in the following embodiments with reference to the accompanying drawings.

BRIEF DESCRIPTION OF THE DRAWINGS

The invention can be more fully understood by referring to the following detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
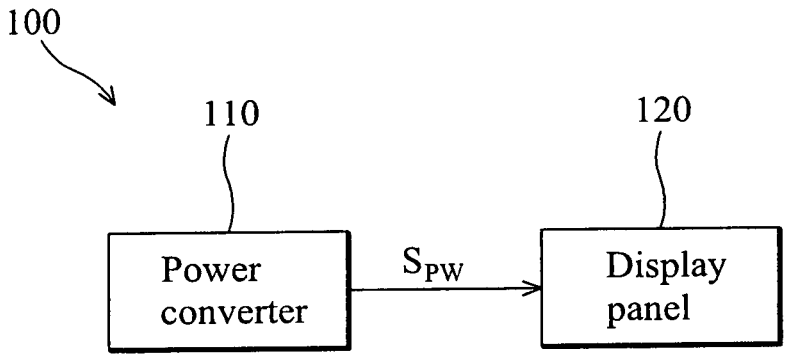
FIG. 1 is a schematic diagram of an exemplary embodiment of an electronic system.

FIG. 1 is a schematic diagram of an exemplary embodiment of an electronic system. The electronic system 100 is a personal digital assistant (PDA), a cellular phone, a notebook or a personal computer (PC). The electronic system 100 comprises a power converter 110 and a display panel 120. The power converter 110 provides a power signal $S_{PW}$ to the display panel 120 such that the display panel 120 displays an image. In one embodiment, the power converter 110 transforms an alternating current (AC) signal into a direct current (DC) signal to serve as the power signal $S_{PW}$. In another embodiment, the power converter 110 transforms the level of a DC signal for generating the power signal $S_{PW}$.

Figure 2:
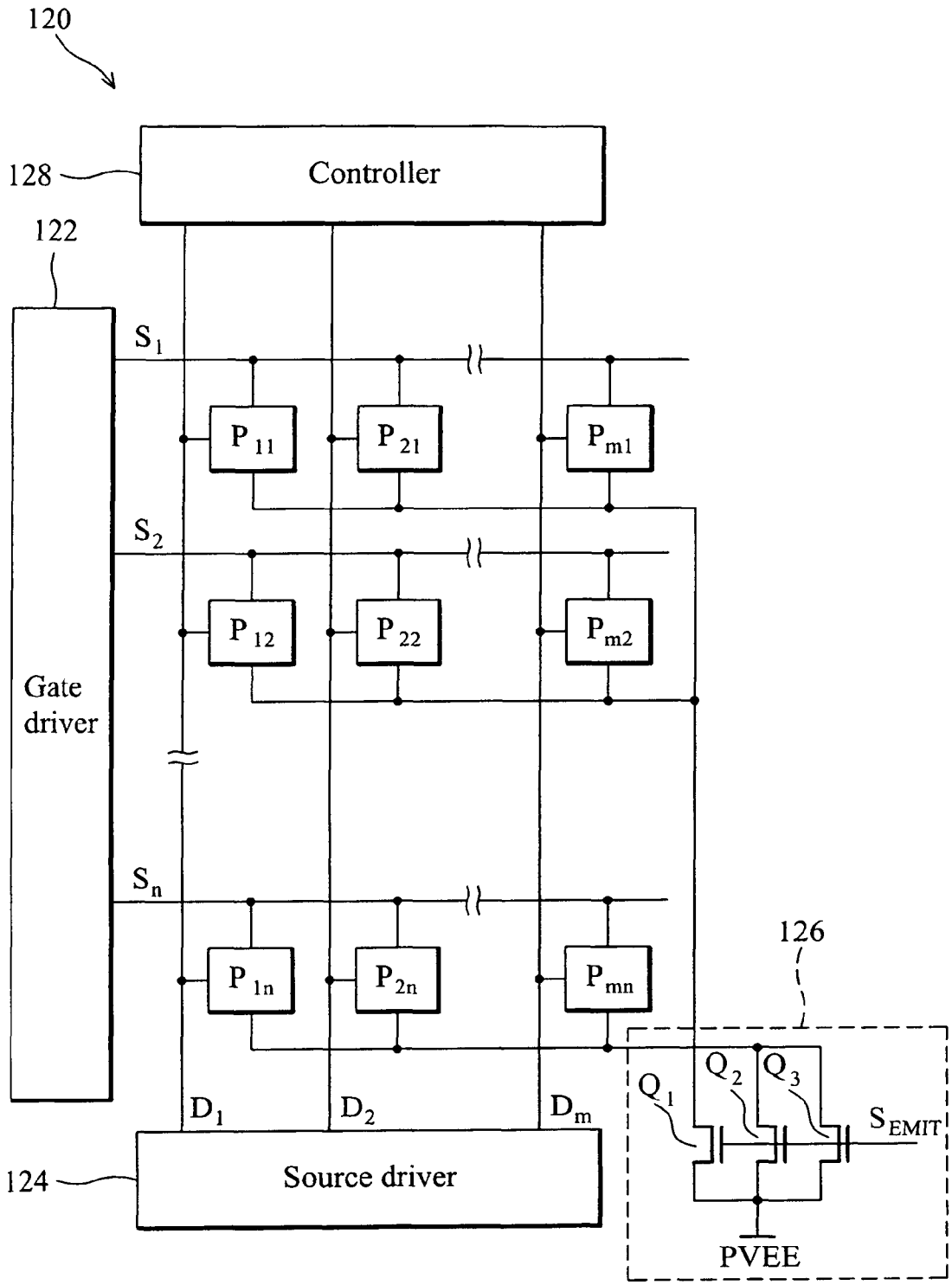
FIG. 2 is a schematic diagram of an exemplary embodiment of a display panel.

FIG. 2 is a schematic diagram of an exemplary embodiment of a display panel. The display panel 120 comprises a gate driver 122, a source driver 124, a cathode switch 126, a controller 128, and pixel units $P_{11}$~$P_{mn}$. The gate driver 122 provides scan signals to the pixel units $P_{11}$~$P_{mn}$ via scan lines $S_1$~$S_n$. The source driver 124 provides data signals to the pixel units $P_{11}$~$P_{mn}$ via data lines $D_1$~$D_m$. The cathode switch 126 is coupled to luminiferous devices of the pixel units $P_{11}$~$P_{mn}$.

In this embodiment, the cathode switch 126 comprises transistors $Q_1$~$Q_3$ connected in parallel. Each of transistors $Q_1$~$Q_3$ comprises a gate receiving a luminiferous signal $S_{EMIT}$. The transistor number of the cathode switch 126 is not limited. In some embodiments, the cathode switch 126 comprises one transistor. The controller 128 provides control signals or voltage to the pixel units $P_{11}$~$P_{mn}$. In this embodiment, the controller 128 provides one or more control signals according to the structures of the pixel units $P_{11}$~$P_{mn}$. In some embodiments, the controller 128 is integrated into the gate driver 122 or the source driver 124.

Figure 3:
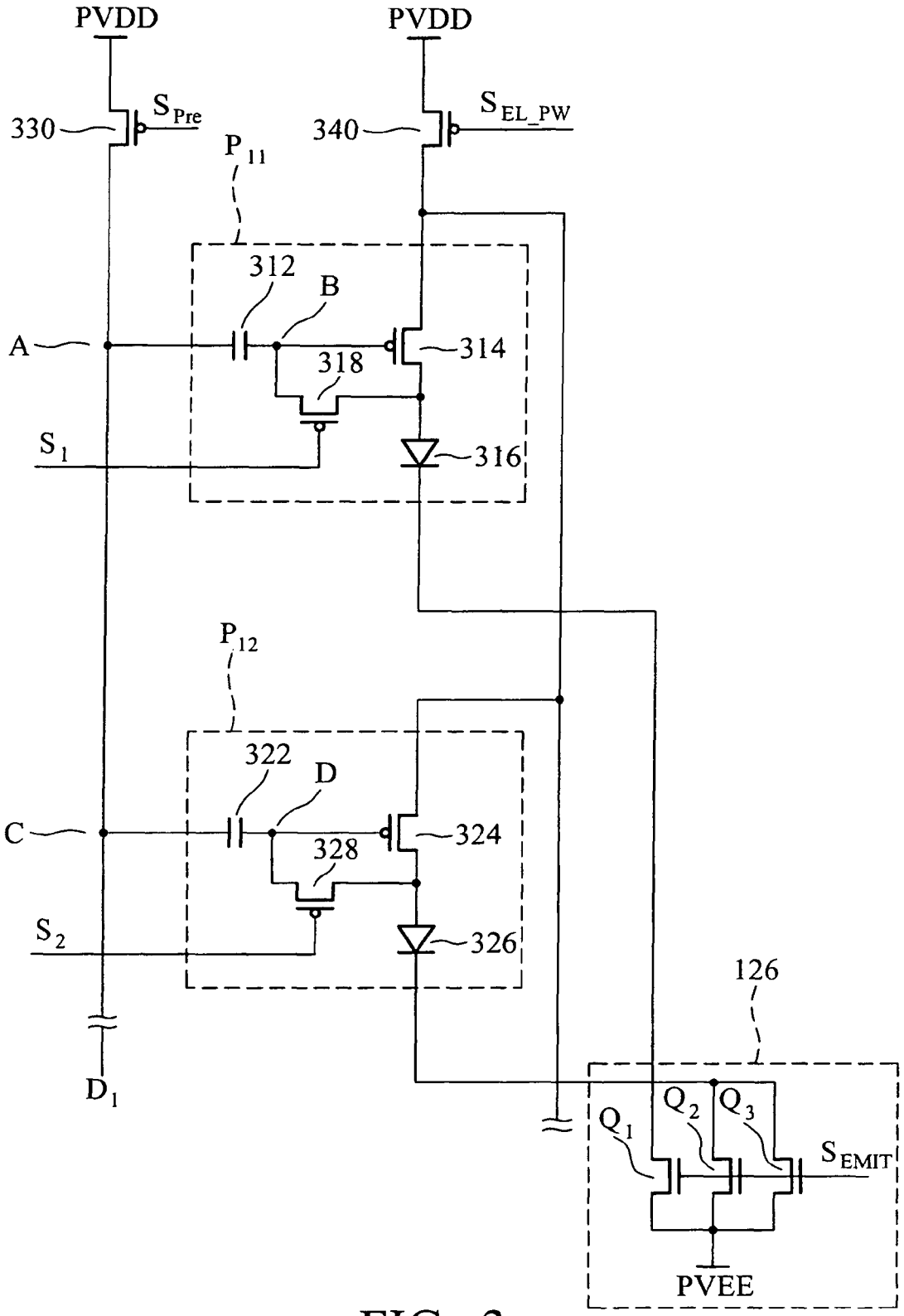
FIG. 3 is a schematic diagram of an exemplary embodiment of a pixel unit.

FIG. 3 is a schematic diagram of an exemplary embodiment of a pixel unit. Since the structures of the pixel units $P_{11}$~$P_{mn}$ are the same, the pixel units $P_{11}$ and $P_{12}$ are given as an example. The pixel unit $P_{11}$ comprises a capacitor 312, transistors 314, 318, and a luminiferous device 316. The gate of the transistor 318 is coupled to the scan line $S_1$. In some embodiments, the transistor 318 is an N-type transistor. The pixel unit $P_{12}$ comprises a capacitor 322, transistors 324, 328, and a luminiferous device 326. The gate of the transistor 328 is coupled to the scan line $S_2$.

A charge switch 330 is a P-type transistor. The P-type transistor comprises a source receiving a voltage signal PVDD, a drain coupled to the capacitors 312, 322 and the data line $D_1$, and a gate receiving a charge signal $S_{Pre}$. A power switch 340 is a P-type transistor. The P-type transistor comprises a source receiving the voltage signal PVDD, a drain coupled to the transistors 314 and 324, a gate receiving a driving signal $S_{EL_pw}$. In this embodiment, the charge switch 330 and the power switch 340 are disposed in the display panel. The controller 128 shown in FIG. 2 provides control signals, such as the voltage signal PVDD, the charge signal $S_{Pre}$, or the driving signal $S_{EL_pw}$, to the charge switch 330 and the power switch 340. In some embodiment, the power switch 340 can be omitted or be replaced by an N-type transistor. When the power switch 340 is omitted, the sources of the transistors 314 and 324 receive the voltage signal PVDD.

Additionally, the cathode switch 126 is coupled to the luminiferous devices 316 and 326. Each of the luminiferous devices 316 and 326 is an Organic Light-Emitting Diode (OLED). The OLED comprises a cathode coupled to the drains of the transistors $Q_1$~$Q_3$. The sources of the transistors $Q_1$~$Q_3$ receive a voltage signal PVEE and the gates of the transistors $Q_1$~$Q_3$ receives the luminiferous signal $S_{EMIT}$. In this embodiment, the controller 128 shown in FIG. 2 provides the luminiferous signal $S_{EMIT}$ and the voltage signal PVEE is less than the voltage signal PVDD.

Figure 4:
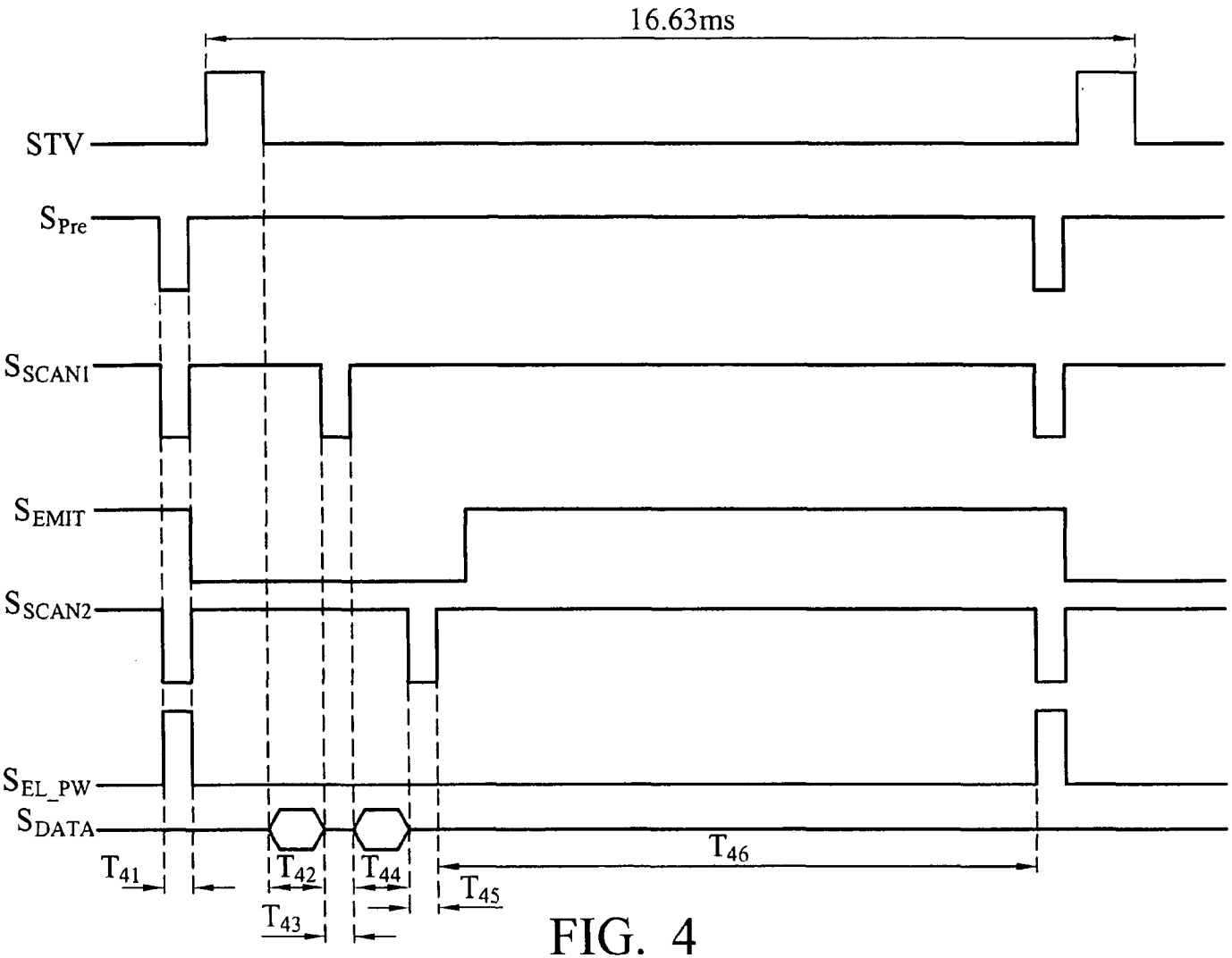
FIG. 4 is a timing chart of an exemplary embodiment of a control method.

FIG. 4 is a timing chart of an exemplary embodiment of a control method. The control method can be applied in the pixel units shown in FIG. 3 or applied in other pixel structures. Referring to FIGS. 2 and 3, an exemplary embodiment of the control method is described in the following. Assuming the display panel requires 16.6 ms to display a frame. Thus, the cycle of a start signal STV is 16.63 ms.

During a period $T_{41}$, the driving signal $S_{EL_PW}$ is in a high level. Thus, the power switch 340 is turned off. Since the scan signal $S_{SCAN1}$ of the scan line $S_1$ is in a low level and the luminiferous signal $S_{EMIT}$ is in the high level, transistors 318 and $Q_1$~$Q_3$ are turned on. Thus, the voltage of a node B is reduced. Since the charge signal $S_{pre}$ is in the low level, the voltage of a node A is increased.

During a period $T_{42}$, the scan sing $S_{SCAN1}$ is in the high level such that the transistor 318 is turned off. Thus, the voltage of the node B is maintained at a fixed value. At this time, the driving signal $S_{EL_PW}$ is in the low level such that the power switch 340 is turned on. Thus, the transistor 314 is turned on. Since the source driver 124 provides the data signal $S_{DATA}$ via the data line $D_1$, the voltage of the node A is reduced. At this time, the voltage of the node A relates to the data signal $S_{DATA}$.

During a period $T_{43}$, the luminiferous signal $S_{EMIT}$ is in the low level. Thus, the transistors $Q_1$~$Q_3$ are turned off. The charge signal $S_{Pre}$ is in the high level such that the charge switch 330 is turned off. Since the source driver 124 does not provide the data signal $S_{DATA}$, the voltage of the node A is maintained. The scan signal $S_{SCAN1}$ and the driving signal $S_{EL_PW}$ are in the low level such that the transistor 318 and the power switch 340 are turned on. Thus, the voltage of the node B is increased. At this time, the voltage of the node B not only relates to the threshold voltage of the transistor 314, but also relates to the voltage signal PVDD.

In this embodiment, the transistor 314 is a driving transistor. The driving transistor generates a driving current according to the voltage of the capacitor 312. The luminiferous device 316 is lit according to the driving current. The driving transistors in different pixel units comprise different threshold voltages due to manufacturing procedures. Thus, when the voltage of the node B relates to the threshold voltage of the corresponding driving transistor during the period $T_{43}$, the different threshold voltage problem can be compensated. Additionally, since the voltage of the node B relates to the voltage signal PVDD, when the pixel units receive the different voltage signals, the luminiferous devices still displays at normal brightness.

During a period $T_{44}$, a scan signal $S_{SCAN2}$ is in the high level such that the transistor 328 is turned off. Thus, the voltage of the node D is maintained. Since the driving signal $S_{EL_PW}$ is in the low level, the power switch 340 and the transistor 324 are turned on. At this time, because the source driver 124 provides the data signal $S_{DATA}$ via the data line $D_1$, the voltage of a node C is increased or reduced according to the data signal $S_{DATA}$. Thus, the voltage of the node C relates to the data signal $S_{DATA}$.

During a period $T_{45}$, the luminiferous signal $S_{EMIT}$ is in the low level. Thus, the transistors $Q_1$~$Q_3$ are turned off. The charge signal $S_{Pre}$ is in the high level such that the charge switch 330 is turned off. Since the data lines $D_1$ does not provide the data signal $S_{DATA}$, the voltage of the node C is maintained at a fixed value.

Since the scan signal $S_{SCAN2}$ and the driving signal $S_{EL_PW}$ are in the low level, the transistor 328 and the power switch 340 are turned on. Thus, the voltage of a node D is increased. At this time, the voltage of the node D not only relates to the threshold voltage of the transistor 324, but also relates the voltage signal PVDD.

During a period $T_{46}$, the charge signal $S_{Pre}$, the scan signals $S_{SCAN1}$ and $S_{SCAN2}$ are in the high level such that the charge switch 330, the transistors 318 and 328 are turned off. Since the luminiferous signal $S_{EMIT}$ is in the high level and the driving signal $S_{EL_PW}$ is in the low level, the transistors 314 and 324 are operated in a saturation region. The transistor 314 generates a driving current according to the voltage of the capacitor 312. The luminiferous device 316 is lit according to the driving current generated by the transistor 314. The transistor 324 generates a driving current according to the voltage of the capacitor 322. The luminiferous device 326 is lit according to the driving current generated by the transistor 324. When the driving current is higher, the brightness of the luminiferous device is higher. Additionally, the data signal $S_{DATA}$ is maintained during the period $T_{46}$. In one embodiment, the data signal $S_{DATA}$ can be maintained in grounding.

Figure 5:
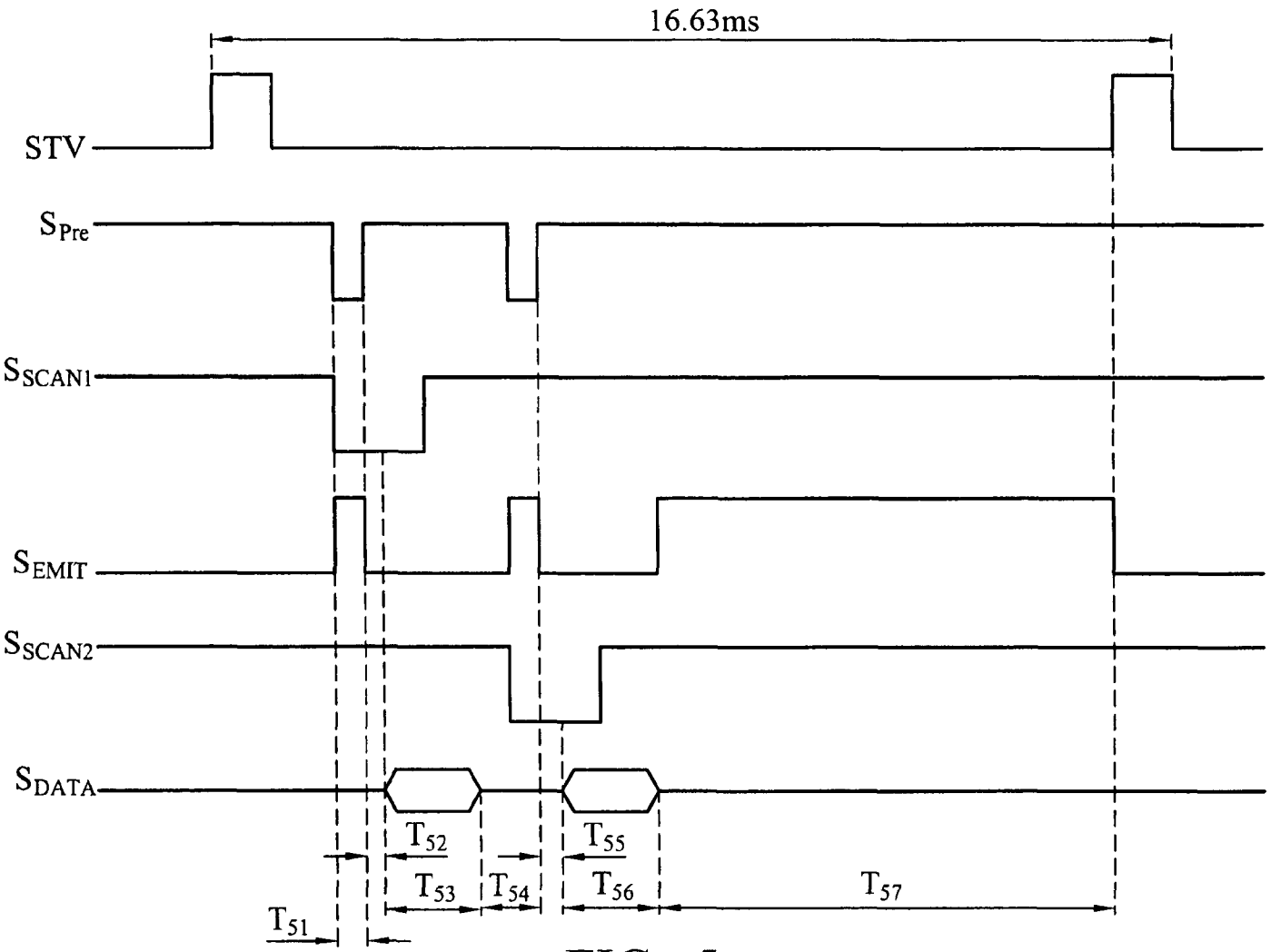
FIG. 5 is a timing chart of another exemplary embodiment of a control method.

FIG. 5 is a timing chart of another exemplary embodiment of a control method. Referring to FIGS. 2 and 3, the control method is described in the following. Assuming the power switch 340 is omitted and the source of the transistor 314 receives the voltage signal PVDD. Since the source of the transistor 314 receives the voltage signal PVDD, the transistor 314 is turned on. In this embodiment, if the display panel requires 16.6 ms to display a frame, the cycle of the start signal STV is 16.63 ms.

During a period $T_{51}$, the charge signal $S_{Pre}$ and the scan signal $S_{SCAN1}$ are in the low level and the luminiferous signal $S_{EMIT}$ is in the high level such that the charge switch 330, the transistors 318 and $Q_1$~$Q_3$ are turned on. Thus, the voltage of the node A is increased and the voltage of the node B is reduced to a fixed value.

During a period $T_{52}$, the luminiferous signal $S_{EMIT}$ is in the low level such that the transistors $Q_1$~$Q_3$ are turned off. The charge signal $S_{Pre}$ is in the high level such that the charge switch 330 is turned off. Thus, the voltage of the node A is maintained at a fixed value. Since the scan signal $S_{SCAN1}$ is in the low level, the transistor 318 is still turned on. Thus, the voltage of the node B is increased. At this time, the voltage of the node B relates to the threshold voltage of the transistor 314. Thus, the different threshold voltage problem can be compensated.

Additionally, if the controller 128 provides the voltage signal PVDD, when the distance between the controller 128 and the pixel unit is longer, the voltage signal PVDD may be reduced. Since the voltage of the node B relates the voltage signal PVDD during the period $T_{52}$, when the different pixel units receive the different voltage signals, the different voltage signals problem can be compensated.

During the first portion of a period $T_{53}$, since the scan signal $S_{SCAN1}$ is in the low level, the transistor 318 is turned on. Thus, the voltage of the node B is increased. During the second portion of the period $T_{53}$, since the scan signal $S_{SCAN1}$ is in the high level, the transistor 318 is turned off. Thus, the voltage of the node B is maintained at a fixed value. When the source driver 124 provides the data signal $S_{DATA}$ via the data line $D_1$, the voltage of the node A is reduced. At this time, the voltage of the node A relates to the data signal $S_{DATA}$.

During the first portion of a period $T_{54}$, since the charge signal $S_{Pre}$ and the scan signal $S_{SCAN2}$ are in the high level and the luminiferous signal $S_{EMIT}$ is in the low level, the charge switch 330, transistors 328 and $Q_1$~$Q_3$ are turned off. Thus, the voltage of the node D is maintained at a fixed value. Since the data line $D_1$ does not provide the data signal $S_{DATA}$, the voltage of the node C is maintained at a fixed value. During the second portion of the period $T_{54}$, since the charge signal $S_{Pre}$ and the scan signal $S_{SCAN2}$ are in the low level and the luminiferous signal $S_{EMIT}$ is in the high level, the charge switch 330, transistors 328 and $Q_1$~$Q_3$ are turned on. Thus, the voltage of the node D is reduced to a fixed value. Since the data line $D_1$ does not provide the data signal $S_{DATA}$, the voltage of the node C is maintained at a fixed value.

During a period $T_{55}$, the luminiferous signal $S_{EMIT}$ is in the low level such that the transistors $Q_1$~$Q_3$ are turned off. The charge signal $S_{Pre}$ is in the high level such that the charge switch 330 is turned off. Thus, the voltage of the node C is maintained. Since the scan signal $S_{SCAN2}$ is in the low level, the transistor 328 is still turned on. Thus, the voltage of the node D is increased. At this time, the voltage of the node D not only relates to the threshold voltage of the transistor 324, but also relates to the voltage signal PVDD.

During a first portion of a period $T_{56}$, since the scan signal $S_{SCAN2}$ is in the low level such that the transistor 328 is turned on. Thus, the voltage of the node D is increased. During a second portion of the period $T_{56}$, since the scan signal $S_{SCAN2}$ is in the high level such that the transistor 328 is turned off. Thus, the voltage of the node D is maintained at a fixed value. When the source driver 124 provides the data signal $S_{DATA}$ via the data line $D_1$, the voltage of the node C is reduced or increased according to the data signal $S_{DATA}$. At this time, the voltage of the node C relates to the data signal $S_{DATA}$.

During the period $T_{57}$, the charge signal $S_{Pre}$, the scan signals $S_{SCAN1}$ and $S_{SCAN2}$ are in the high level such that the charge switch 330, the transistors 318 and 328 are turned off. Since the luminiferous signal $S_{EMIT}$ is in the high level, the transistors 314 and 324 are operated in a saturation region. The transistor 314 generates a driving current according to the voltage of the capacitor 312. The luminiferous device 316 is lit according to the driving current generated by the transistor 314. The transistor 324 generates a driving current according to the voltage of the capacitor 322. The luminiferous device 326 is lit according to the driving current generated by the transistor 324. When the driving current is higher, the brightness of the luminiferous device is higher. Additionally, the data signal $S_{DATA}$ is maintained during the period $T_{57}$.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A control method controlling a display panel comprising a pixel unit, wherein the pixel unit is coupled to a data line and comprises a capacitor, a first transistor, and a luminiferous device, wherein the luminiferous device comprises a cathode and an anode coupled to the first transistor, and wherein the capacitor comprises a first terminal coupled to the data line and a second terminal coupled to the first transistor, comprising:

increasing the voltage of the first terminal and reducing the voltage of the second terminal during a first period;

providing a first voltage signal directly to the cathode during the first period;

controlling the voltage of the first and the second terminals during a second period subsequent to the first period;

stop providing the first voltage signal to the cathode during the second period;

lighting the luminiferous device according to the voltage of the capacitor during a third period subsequent to the second period; and providing the first voltage signal directly to the cathode during the third period, wherein the voltage of the data line is maintained during the third period.

2. The control method as claimed in claim 1, wherein during the second period, the voltage of the first terminal is reduced and the voltage of the second terminal is maintained and following, the voltage of the first terminal is maintained and the voltage of the second terminal is increased.

3. The control method as claimed in claim 1, wherein during the second period, the voltage of the first terminal is maintained and the voltage of the second terminal is increased and following, the voltage of the first terminal is reduced and the voltage of the second terminal is increased and then maintained.

4. The control method as claimed in claim 1, wherein the display panel further comprises a cathode switch providing the first voltage directly to the cathode of the luminiferous device, a charge switch comprising a drain coupled to the capacitor and the data line, and a second transistor, wherein when the first transistor and the cathode switch are turned on and the second transistor and the charge switch are turned off, the luminiferous device is lit according to the voltage of the capacitor.

5. A display panel, comprising:

a pixel unit comprising:

a capacitor comprising a first terminal coupled to a data line and a second terminal, wherein the voltage of the first terminal is increased and the voltage of the second terminal is reduced during a first period, and wherein the voltage of the first and the second terminals are controlled during a second period subsequent to the first period;

a first transistor coupled to the second terminal; and a luminiferous device, which is lit according to the voltage of the capacitor during a third period subsequent to the second period, wherein the voltage of the data line is maintained during the third period; and a cathode switch coupled to the luminiferous device, wherein luminiferous device comprises a cathode and an anode, and wherein the cathode switch provides a first voltage signal directly to the cathode of the luminiferous device during the first and the third periods and stops providing the first voltage signal to the cathode of the luminiferous device during the second period.

6. The display panel as claimed in claim 5, wherein during the second period, the voltage of the first terminal is reduced and the voltage of the second terminal is maintained and following, the voltage of the first terminal is maintained and the voltage of the second terminal is increased.

7. The display panel as claimed in claim 5, wherein during the second period, the voltage of the first terminal is maintained and the voltage of the second terminal is increased and following, the voltage of the first terminal is reduced and the voltage of the second terminal is increased and then maintained.

8. The display panel as claimed in claim 7, further comprising a charge switch, wherein the charge switch comprises a drain coupled to the capacitor and the data line.

9. The display panel as claimed in claim 8, further comprising a power switch, wherein the power switch provides a second voltage signal to the first transistor when the power switch is turned on.

10. The display panel as claimed in claim 8, wherein the voltage of the first terminal is reduced when the first terminal receives a data signal provided by the data line.

11. The display panel as claimed in claim 8, further comprising a second transistor, wherein when the first transistor and the cathode switch are turned on and the second transistor and the charge switch are turned off, the luminiferous device is lit according to the voltage of the capacitor.

12. The display panel as claimed in claim 5, further comprises a charge switch comprising a drain coupled to the capacitor and the data line, and a second transistor, wherein when the first transistor and the cathode switch are turned on and the second transistor and the charge switch are turned off, the luminiferous device is lit according to the voltage of the capacitor.

13. An electronic system, comprising:

a display panel comprising:

a pixel unit comprising:

a capacitor comprising a first terminal coupled to a data line and a second terminal, wherein the voltage of the first terminal is increased and the voltage of the second terminal is reduced during a first period, and wherein the voltage of the first and the second terminals are controlled during a second period subsequent to the first period;

a first transistor coupled to the second terminal; and a luminiferous device, which is lit according to the voltage of the capacitor during a third period subsequent to the second period, wherein the voltage of the data line is maintained during the third period; and a cathode switch coupled to the luminiferous device, wherein luminiferous device comprises a cathode and an anode, and wherein the cathode switch provides a first voltage signal directly to the cathode of the luminiferous device during the first and the third periods and stops providing the first voltage signal to the cathode of the luminiferous device during the second period; and a power converter providing a power signal to the display panel.

14. The electronic system as claimed in claim 13, wherein the power converter transforms an alternating current (AC) signal to generate the power signal.

15. The electronic system as claimed in claim 14, wherein the electronic system is a personal digital assistant (PDA), a cellular phone, a notebook or a personal computer (PC).

16. The electronic system as claimed in claim 13, wherein the display panel further comprises a charge switch comprising a drain coupled to the capacitor and the data line, and a second transistor, wherein when the first transistor and the cathode switch are turned on and the second transistor and the charge switch are turned off, the luminiferous device is lit according to the voltage of the capacitor.

* * * * *